from said supports to the scaffolding frames F and the suspending members on scaffolding frames F are disconnected, as shown in FIG. 8*b*. The scaffolding frames F are moved upward one stage and the suspending members are connected to the supports 20 thereat, as shown in FIG. 8*c*. After all the unit cylinders 1 are completely joined, said scaffolding frames F are fixed to the upper parts of the top unit cylinders 1, as roof frames, and roof slabs are placed on such roof frames. Thus, the construction can be executed very simply. With this means, the raising of the scaffolding frames F and the lifting of the unit cylinders 1 are by cranes, and the scaffolding frames F have only one stage, but as an alternative, scaffolding frames F with two working floors 21 and 22 corresponding to upper and lower stages may be used as shown in FIGS. 9*a* and 9*b*. In this case, the joining to an already assembled first unit cylinder t of a next higher unit cylinder t is carried out from the working floor of the upper stage 21, while the working floor 22 of the lower stage is supported by the suspending supports 20 mounted in the inserts 19 of the already assembled unit cylinder t one stage below said first unit cylinder t, as shown in FIG. 9*a*, and after said second unit cylinder t is joined to said first unit cylinder t, the hooks 23 of lifters I mounted on the scaffolding frame F are hung on the top of said second unit cylinder t as also shown in FIG. 9*a*. Then after the suspending supports 20 are released, the scaffolding frame F is raised by said lifters I one stage higher, and the position of said suspending supports 20 is changed to the inserts 19 in said first unit cylinder t, as shown in FIG. 9*b*. In this way the lengthwise and crosswise arranged unit cylinders are assembled while the scaffolding frames F are raised stage by stage. On the upper stage working floor 21, the unit members 1 constituting the unit cylinder t are joined as described above, and on the lower stage working floor 22 the clamping by the horizontal clamp rods 5 and 6 and joint treatment are carried out. Since different operations can be carried out simultaneously on the upper and lower stage working floors 21 and 22 in this way, the time normally to allow for the generation of sufficient strength of the concrete 7 and the mortar 8 can be saved. Therefore, the construction can be carried out faster, which is an advantageous effect of this aspect of the invention. In addition, since the scaffolding frames F are raised without using a heavy machine such as crane, but rather by the lifters I set in the scaffolding frames F themselves, safety and economy are promoted.

In the present invention, as described above, using precast concrete members as unit component members, silo cylinders are constructed lengthwise and crosswise from said unit members, to form a silo complex with the silo cylinders as main silo means and the spaces formed among the adjacent silo cylinders as sub silo means. Particularly, in the present invention, the unit members are joined lengthwise, crosswise and vertically in a very simple way, and such lengthwise, crosswise and vertical structure can be used to prestress the concrete. Therefore, the lengthwise and crosswise arranged silo cylinders are substantially solidified as regards dynamics and structure, and the circumferential tensile force caused by the internal pressure due to the contents such as grain and the horizontal and vertical shearing forces from an external force due to an earthquake, wind, etc, can be transmitted favorably, so that the silo cylinders are very solid. In the present invention, furthermore, since accurately dimensioned precast concrete members produced under close control are used as unit members, air does not leak through said unit members at all, and therefore, by providing sufficient airtight treatment of the longitudinal and transverse joints between such unit members, silo cylinders with very high airtightness can be easily constructed, which is a feature of the present invention. As for the transverse joints, reinforced concrete is provided in the coupling spaces formed between adjacent unit members in adjacent silo cylinders to solidfy and to provide a connection to the adjacent silo cylinders, and therefore airtightness is high. Furthermore, in the longitudinal joints, the provision of the gasket as described above makes it possible for good airtightness to be secured easily. Thus, by the present invention, one can easily construct silo cylinders with good airtightness. In addition, in the present invention, since all the work can be done from within the cylinders or in the spaces formed among the cylinders other than where molds and scaffolding are partially positioned outside, the construction is easy. Moreover, since the most of the silo cylinders is made of precast concrete produced in the factory, it is possible to reduce the amount of field work, the number of workers required at a given time is not unlike that for the conventional sliding form method, etc, enabling the construction to be carried out at constant work volume and with a constant work force and allowing easy control, which is a further feature of the present invention.

We claim:

1. A precast concrete member for use in constructing a concrete silo complex having a plurality of side-by-side silos, said member having a quarter-cylindrical configuration for being arranged in end-to-end fashion to form a cylinder unit, said member further having radially outwardly projecting coupling elements integral therewith and extending the full height of said member, one of said coupling elements being disposed adjacent each end of said member and said member having an end portion extending from each of said coupling elements to the corresponding end thereof, said coupling element having an outer end surface adapted to face a like outer end surface of a coupling element on a member in a cylinder unit in an adjacent silo, whereby said coupling element and the end portion adjacent thereto, with the corresponding coupling element and end portion on the adjacent member in the cylinder unit and the coupling elements on the members of the cylinder unit of an adjacent silo, form a box-like space for receiving concrete, said coupling elements having means for receiving tie means extending across said box-like space between two adjacent coupling elements, and said marginal end portions having means for receiving tie means extending across said box-like space between the end portion and the end portion of the member in the adjacent silo.

2. A precast concrete member as defined in claim 1 in which said member has a lower edge with means thereon for nesting engagement with the upper edge of a like member positioned below said member, whereby one of said members can be stacked on another member to form a silo of a pile of said cylinder units; and said member having means to receive vertically extending tie means for prestressing the thus stacked members.

3. A precast concrete silo complex comprising: a plurality of side-by-side silos, each silo being constituted by a plurality of members each having a quarter-cylindrical configuration and arranged in end-to-end fashion to form a plurality of cylinder units, each member fur-

SHEAR REINFORCEMENT FOR CONCRETE FLAT SLABS

This is a continuation of application Ser. No. 016,323, filed Feb. 27, 1979 and now abandoned.

FIELD OF THE INVENTION

The invention relates to the reinforcement of concrete slabs in the vicinity of columns.

In conventional construction, flat concrete slabs, for economical reasons are extensively utilized to fabricate floor systems.

In the vicinity of floor supporting columns however the flat concrete slabs are subjected to large bending moments and shearing forces, and the effect of these high shear and flexural stress can cause failure by "punching" of the slab. The failure is usually brittle and takes place by widening of an inclined crack which extends first to the top tensile fibre adjacent the column perimeter and thereafter propagates to the bottom (compression) surface of the slab.

Since the shear strength of the slab is frequently considerably smaller than the flexural strength, it is necessary to provide reinforcement to prevent punching.

SUMMARY OF THE INVENTION

The present invention therefore provides such a reinforcement and additionally provides a method of utilizing such reinforcements such that failure of a slab by "punching" is substantially prevented.

Accordingly the invention comprises a reinforcement for flat concrete plate comprising a plurality of substantially vertical elongate reinforcing elements fixedly attached in spaced horizontal relation to support means, each element, at least adjacent one end thereof being provided with an enlarged portion which serves to act as an anchor when the reinforcement is embedded within the concrete slab. In their preferred form, the element consists of thin transverse sections of an I-beam, the support being provided by at least one intermediate horizontal member to which each I-section is welded.

In an alternate form, the invention consists in a plurality of spaced apart steel rods mounted substantially vertically from a thin substantially flat supporting base plate, the rods at their upper ends being enlarged, or provided with suitable attachments to facilitate anchorage of the reinforcement within the concrete slab.

BRIEF DESCRIPTION OF THE DRAWINGS

The invention will now be described by way of example only, reference being had to the accompanying drawings in which:

FIG. 3(*b*) is a schematic representation of an alternative form of reinforcing element according to the invention;

FIG. 4(*b*) shows one method of arranging the reinforcing elements according to FIG. 3(*b*) in the vicinity of a supporting column;

DESCRIPTION OF THE PREFERRED EMBODIMENT(S)

Figure 1:
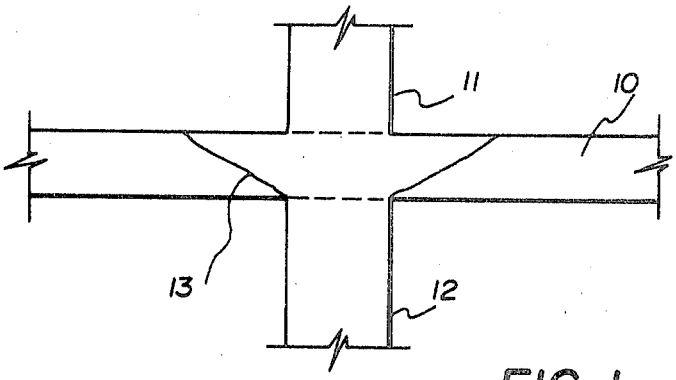
FIG. 1 is a cross-section of a concrete slab at the area of interconnection with a vertical column, showing a potential "punching" failure crack.
Figure 2:
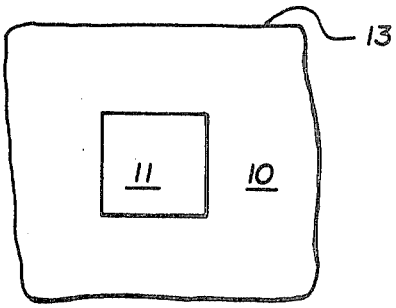
FIG. 2 is a top view of the structure according to FIG. 1 showing the intersection of the failure crack with the top surface of the slab.

Referring now to the drawings, FIGS. 1 and 2 show a typical concrete floor slab 10 sandwiched between upper and lower supporting columns 11 and 12 respectively. As indicated previously high shear and flexural stresses are present which tend to cause the so-called punching shear failure of the slab, the propagation of this crack being indicated at 13.

In order to prevent such failure it is required to provide reinforcement in a zone around the supporting columm where inclined shear cracks 13 are forming a failure surface in the form of a cone or pyramid. The shear reinforcement to be effective must intersect the above mentioned failure surface in a vertical or inclined direction.

Tests have shown that shear reinforcement is effective only if the elements are well anchored in the tension and compression zone of the slab and that the shear strength of slabs can only be increased if the reinforcement is effectively anchored.

The conventional forms of shear reinforcement such as closed stirrups with longitudinal bars in the stirrup corners are very difficult to place and hence unpractical. Other forms of stirrups made up of vertical bars welded to transverse bars are also not satisfactory due to anchorage slip and the problem of emplacement of slab flexural reinforcements which require insertion under the transverse anchor bars of the shear reinforcements.

Other means of increasing the shear strength of flat slabs are so-called "shear heads" where structural steel beams are welded to form a cross, which is placed in the slab over, or under a column. However, considerable difficulty exists in the placement of such a shear head since it interferes with the placing of the flexural reinforcement. For those slabs most commonly used in the construction of apartment or office buildings, the size of the structural steel beams, which can be accommodated within the depth of the concrete slab may not be sufficient to increase substantially the sheer strength of the slab. In addition, the cost of the sheer head is substantial and may be prohibitive.

The present invention however seeks to provide an efficient means to increase the shear strength of flat concrete slabs, such that it substantially equals the flexural strength.

Numerous advantages are realized by the inventive structure, some of which are: (a) an increase in load carrying capacity; (b) an avoidance of punching failure; (c) an increase in the ductibility of the slab which means that should failure accidentally occur, it would be preceeded by large deformations giving sufficient warning to enable remedial measures to be implemented. The latter would be a desirable feature in geographical areas prone to earthquakes; (d) the shear reinforcement according to the invention would not interfere with the placement of flexural reinforcement which is provided near the bottom and the top surfaces of the slab in the vicinity of the supporting column and finally; (e) is easy to install and maintain in an appropriate position during casting of the concrete slab.

Figure 3A:
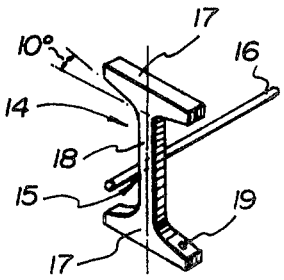
FIG. 3(*a*) is a schematic representation of a preferred form of reinforcing element according to the invention.
Figure 3B:
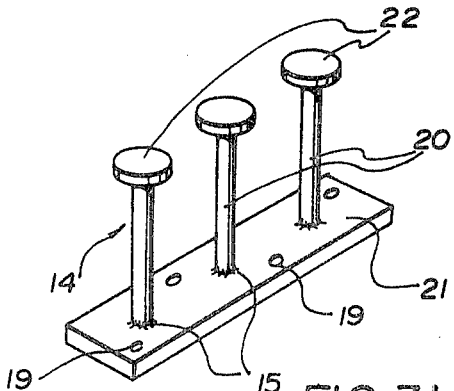

In a preferred form, as shown in FIG. 3(*a*), the inventive structure consists in a plurality of substantially vertically positioned individual shear elements 14 produced by cutting short segment (5–50 mm) from a standard I-section beam or any other suitable rolled steel beam. The elements 14 are attached in spaced relation, as by welding 15 to a supporting steel rod 16, in this example one such rod has been shown, however more than one such attachment may be used. The location of the rod 16 is arbitrary but as will be appreciated, the rod 16 may serve as an effective support for the top mesh of a suitable flexural reinforcement.

As also will be appreciated, element 14 can be preassembled in line of length suitable for transportation and be cut to the desired length of site.

The flared flanges 17 of elements 14 provide an ideal shape for the transmission of the anchor forces to the concrete as the flare of the flange provides more strength near the stem of the web 18 where the bending moments are highest. Also, the shape of the flange assists the air which rises during vibrating of the slab concrete, during setting, to escape from underneath the flanges 17, where stresses on the concrete are highest. As will be accepted, should air be entrapped under the flange, the anchorage of this type of shear element may be weakened. For this and other reasons mentioned above, a slope of 10° or more on all types of top anchor is desirable. In each element 14 a hole 19 is provided to facilitate attachment of the bottom anchor to the framework of the mould into which the concrete is poured.

An alternative form of reinforcing element is shown in FIG. 3(*b*). In this example, elements 14 comprise substantially vertical spaced-apart rods 20 attached as by welds 8 to a bottom steel plate or strip 21. Mechanical anchors 22 are provided on the upper ends of rods 20 which anchors serve the same purpose as previously described upper flange 17. The underside surface of anchors 22 are preferably formed with a taper, in the region of 10°, to facilitate the escape of air during casting of the concrete. These mechanical anchors may consist of small steel plates welded to the vertical rods 20, or alternatively the rods 20 may be hot or cold formed in the area of their upper ends, in a manner similar to the process used to fabricate shear studs. While the rods 20 have been depicted as vertically extending from the base plate 21, it may be advantageous to incline the rods with respect to the vertical.

Figure 4A:
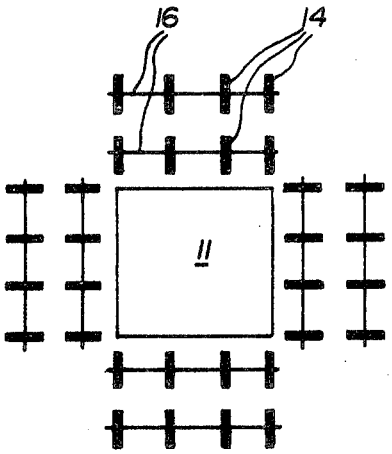
FIG. 4(*a*) shows one method of arranging the reinforcing elements according to FIG. 3(*a*) in the immediate vicinity of a supporting column.
Figure 4B:
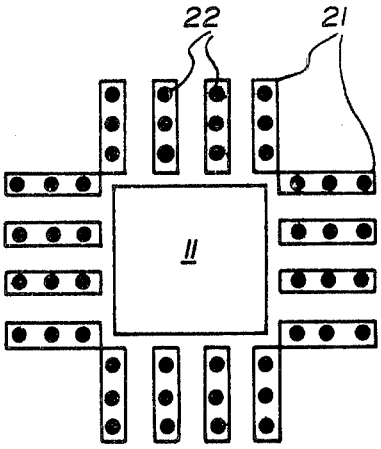

FIGS. 4(*a*) and 4(*b*) show two preferred methods of arranging the reinforcing elements 14 of FIGS. 3(*a*) and 3(*b*) respectively about a supporting column 11.

In the case according to FIG. 4(*b*) it may be advantageous to arrange the positioning to strips 21, perpendicular to the face of the column and let the steel strip reach the column face or project slightly into the column area in order to utilize the compression components of these plates. This will result in a reduction of the high concrete compression stresses of the slab concrete in this zone. This arrangement is, however, not mandatory.

Figure 6:
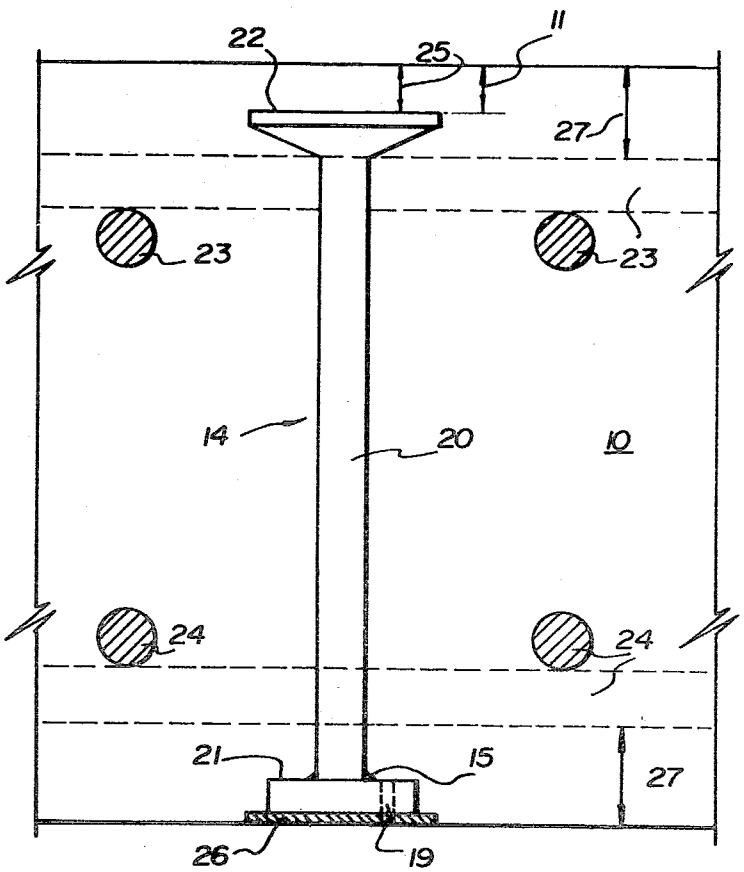
FIG. 6 is a fragmentary vertical cross-section of a concrete slab showing the relative placement of a reinforcing element according to FIG. 3(*b*)
Figure 5:
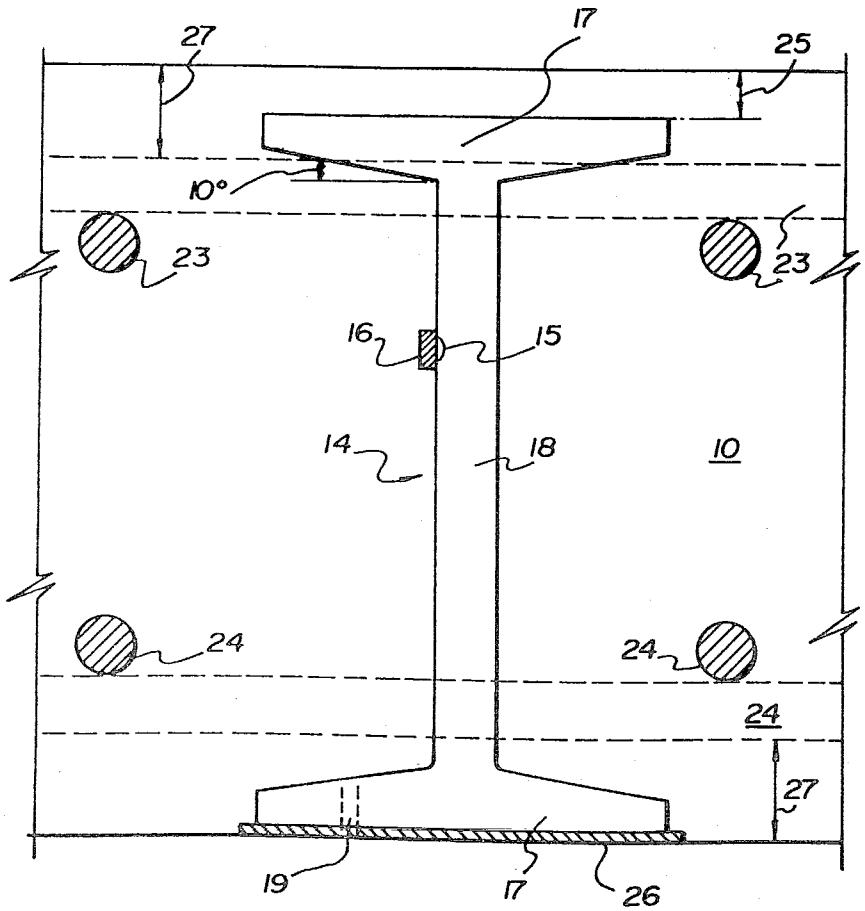
FIG. 5 is a fragmentary vertical cross-section of a concrete slab showing the relative placement of a reinforcing element according to FIG. 3(*a*)

FIGS. 5 and 6 show the relative placement of elements 14 within a concrete slab 10. Also shown in these figures are the conventional form of top and bottom mesh flexural reinforcements enumerated 23 and 24 respectively.

The mechanical anchor of the shear elements 14 should be as close to the concrete top and bottom surfaces as is feasible i.e. the concrete cover 25 should be as small as possible. No concrete cover would be the best solution with regard to the strength developed by the inventive reinforcement because the anchor zone of the shear elements 14 in the compression zone would not be intersected by the inclined shear cracks, thus weakening the anchor zone.

The case of zero cover, may, however be in conflict with fire safety regulations. Therefore, in order to provide the required fire rating, which is standard for reinforced concrete buildings, there is provided (FIGS. 5, 6 and 7) a thin plate 26 of fire resistant material, such as asbestos, placed below the bottom anchor plate. Adequate fire protection above the top anchor may also be provided, if required, by a similar asbestos or other low thermal conducting material, or by an appropriate concrete cover. Should any metal surfaces project to the surface of the concrete, a suitable corrosion preventive substance may be applied. In FIGS. 5 and 6, the thickness of concrete indicated at 27 represents the usual concrete cover for the flexural reinforcements 23 and 24.

Figure 7:
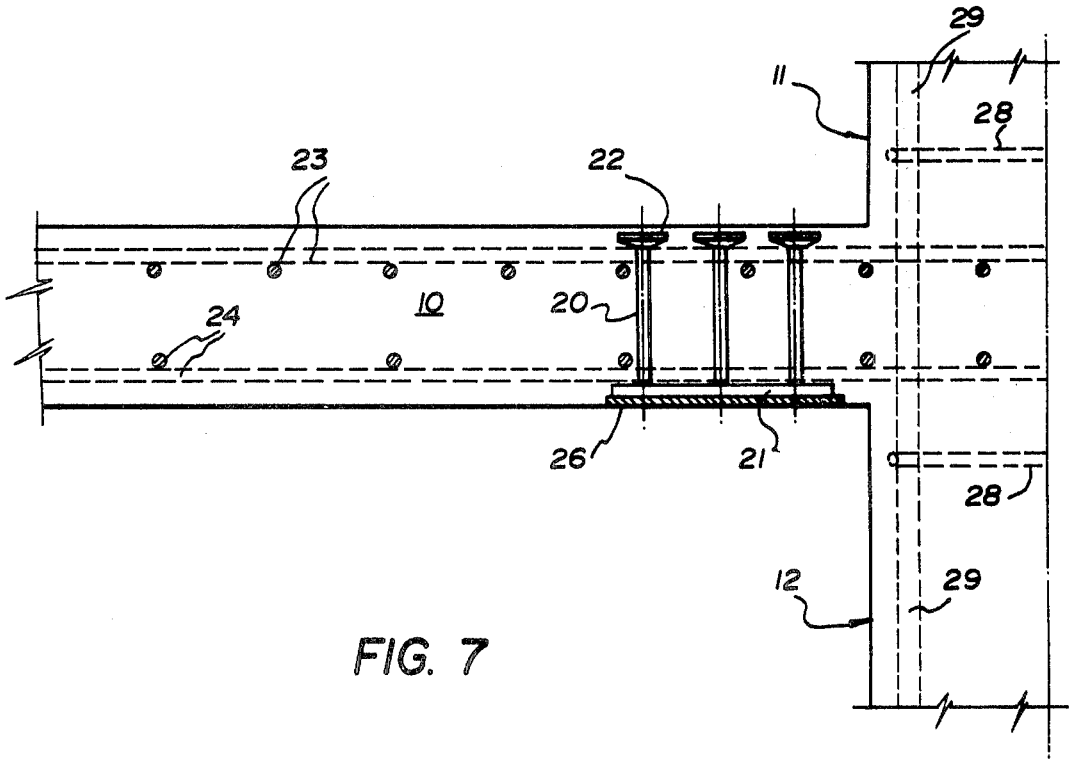
FIG. 7 is a fragmentary vertical cross-section perpendicular to the column face for the slab shown in FIG. 4(*b*).

Finally, referring to FIG. 7, there is shown in vertical cross-section, the reinforcement of a floor section 10 and supporting columns 11 and 12. Elements 14 in accordance with FIG. 3(*b*) are shown in position, the conventional reinforcing of columns 11 and 12 are indicated at 28 and 29.

Further modifications and alternative embodiments of the invention will be apparent to those skilled in the art in view of the foregoing description. Accordingly, this description is to be construed as illustrative only and is for the purpose of teaching those skilled in the art the manner of carrying out the invention. It is further understood that the form of the invention herewith shown and described is to be taken as the presently preferred embodiment. Various changes may be made in the shape, size and general arrangement of components. For example, equivalent elements may be substituted for those illustrated and described herein, parts may be used independently of the use of other features, all as will be apparent to one skilled in the art after having the benefit of the description of the invention.

What is claimed is:

1. In the reinforcement of a column supported concrete slab having upper and lower surfaces and said slab including portions extending outwardly and transversely from said columns supporting said slab, and in the area of said slab immediately adjacent said columns including a plurality of unconnected reinforcement members arranged in a pre-determined pattern and in embedded within that portion of said slab extending outwardly from said columns and laterally spaced from and adjacent to that portion of said slab directly overlying said columns, each of said reinforcement members comprising:

a. support means, b. a plurality of substantially vertically arranged elongate reinforcement elements having at least one projecting end, c. said elements fixedly attached in spaced horizontal relation to said support means, and d. mechanical anchoring means provided for each reinforcement element, at least adjacent said projecting end thereof, for anchoring said reinforcement elements in the concrete slab adjacent at least one surface thereof.

2. The reinforcement member according to claim 1 wherein said reinforcing elements are of substantially constant thickness throughout their length and are generally I-shaped in vertical cross-section, having upper and lower horizontal flanges and a centrally disposed vertical flange supporting web.

3. The reinforcement member according to claim 2 wherein said support means comprises at least one horizontally disposed member, each said element being attached to said member intermediate said flanges such that the vertical axis of said element is substantially normal to said member.

4. The reinforcement member according to claim 3 wherein the top surface of each said flange is substantially flat and the under surface of each said flange is inclined inwardly towards said web, on each said thereof, at an angle of at least 10°.

5. The reinforcement member according to claim 1 comprising a base member consisting of a flat elongate steel plate, of constant thickness throughout its length, a plurality of rod-like elements mounted from one surface of said plate such that the longitudinal axis of each said element is substantially normal to said surface, each said element provided at its end remote from said base member with said mechanical anchor means.

6. The reinforcement according to claim 5 wherein said mechanical anchor means comprises a plate like member fixedly attached to said element.

7. The reinforcement member according to claim 5 wherein said mechanical anchor means comprises an upper portion of said element adjacent its end, mechanically deformed to affect an enlargement thereof.

8. The reinforcement member according to claim 2 wherein the undersurface of said lower flange is provided with a covering of fire resistant material.

9. The reinforcement member according to claim 5 wherein the undersurface of said base is provided with a covering of fire resistant material.

* * * * *